US007743813B2

(12) United States Patent
Haffamier et al.

(10) Patent No.: US 7,743,813 B2
(45) Date of Patent: Jun. 29, 2010

(54) CORNICE FIXTURE

(76) Inventors: Kathleen Haffamier, 2130 Sumter Lake Dr., Marietta, GA (US) 30062; Eric Michael Ringer, 1837 Duke Rd., Atlanta, GA (US) 30341

( * ) Notice: Subject to any disclaimer, the term of this patent is extended or adjusted under 35 U.S.C. 154(b) by 1304 days.

(21) Appl. No.: 11/194,165

(22) Filed: Aug. 1, 2005

(65) Prior Publication Data

US 2006/0070705 A1 Apr. 6, 2006

Related U.S. Application Data

(63) Continuation-in-part of application No. 10/907,510, filed on Apr. 4, 2005.

(60) Provisional application No. 60/592,962, filed on Aug. 2, 2004.

(51) Int. Cl.
*A47H 2/02* (2006.01)

(52) U.S. Cl. ..... 160/39; 160/348

(58) Field of Classification Search ..... 160/39, 160/38, 19, 348, 330, 84.01, 902, 903, 405; 16/87.2, 87.4 R; 24/716; 248/251, 257, 248/262, 265

See application file for complete search history.

(56) References Cited

U.S. PATENT DOCUMENTS 1,203,765 A * 11/1916 Miller ..... 248/263
2,681,697 A 6/1954 Mandella
3,064,724 A * 11/1962 Nowell ..... 160/330
3,433,281 A 3/1969 Lukashok
3,437,127 A 4/1969 Lukashok
3,561,714 A 2/1971 Zurawski
3,996,987 A 12/1976 Rodriguez
4,228,980 A 10/1980 Beauchamp et al.
4,662,596 A 5/1987 Haarer
4,991,640 A 2/1991 Verkindt
5,033,525 A 7/1991 Paeselt
5,039,049 A 8/1991 Niemi
5,042,548 A 8/1991 Attal
5,063,985 A 11/1991 Bozzo
5,067,542 A 11/1991 Easley
5,074,348 A 12/1991 Phillips
5,090,095 A 2/1992 Lightfoot
5,094,006 A 3/1992 Varney
5,259,687 A 11/1993 John
5,316,067 A 5/1994 LeClaire
5,330,821 A 7/1994 Lo
5,335,709 A 8/1994 Borzi
5,503,209 A 4/1996 Healzer
5,520,234 A 5/1996 Simmons
5,570,490 A 11/1996 Walsh
5,597,025 A 1/1997 Forkner
5,673,741 A 10/1997 Cairns
5,833,193 A 11/1998 Derda
6,056,035 A 5/2000 Laster-Bivens
6,085,821 A 7/2000 Roberts
6,173,753 B1 1/2001 Laster-Bivens (Continued)

*Primary Examiner*—David Purol
(74) *Attorney, Agent, or Firm*—Sentry Law Group

(57) ABSTRACT

A cornice fixture for decorating a wall and a method of installing the cornice fixture are disclosed. The cornice fixture includes a rod from which window treatments are hung and at least one bracket. Typically, the cornice fixture includes a pair of brackets, and the rod is slidably coupled to the brackets. Slidably coupling the rod to the brackets enables the installer to center the rod about a given point after the rod has been coupled to the bracket.

11 Claims, 8 Drawing Sheets

102

U.S. PATENT DOCUMENTS

| | | | |
|---|---|---|---|
| 6,182,739 | B1 | 2/2001 | Jones |
| 6,192,962 | B1 | 2/2001 | Glover |
| 6,463,984 | B2 | 10/2002 | Glover |
| 6,508,295 | B2 | 1/2003 | Whittemore |
| 6,648,046 | B1 | 11/2003 | Gibson |
| 6,732,783 | B2 | 5/2004 | Bouldin |
| 2001/0008176 | A1 | 7/2001 | Glover |
| 2003/0029822 | A1 | 2/2003 | Fitzsimmons |

* cited by examiner

102

FIG. 4A
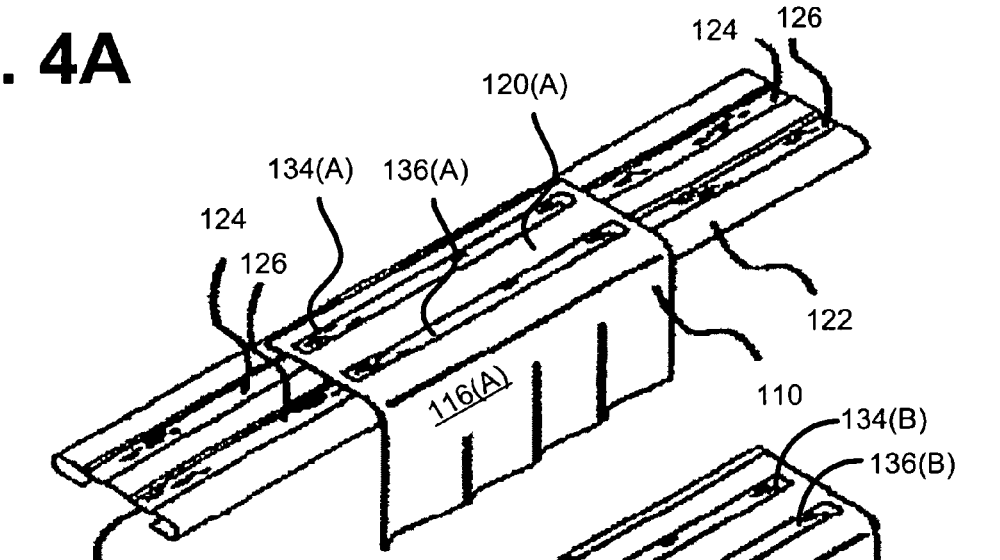
FIG. 4B
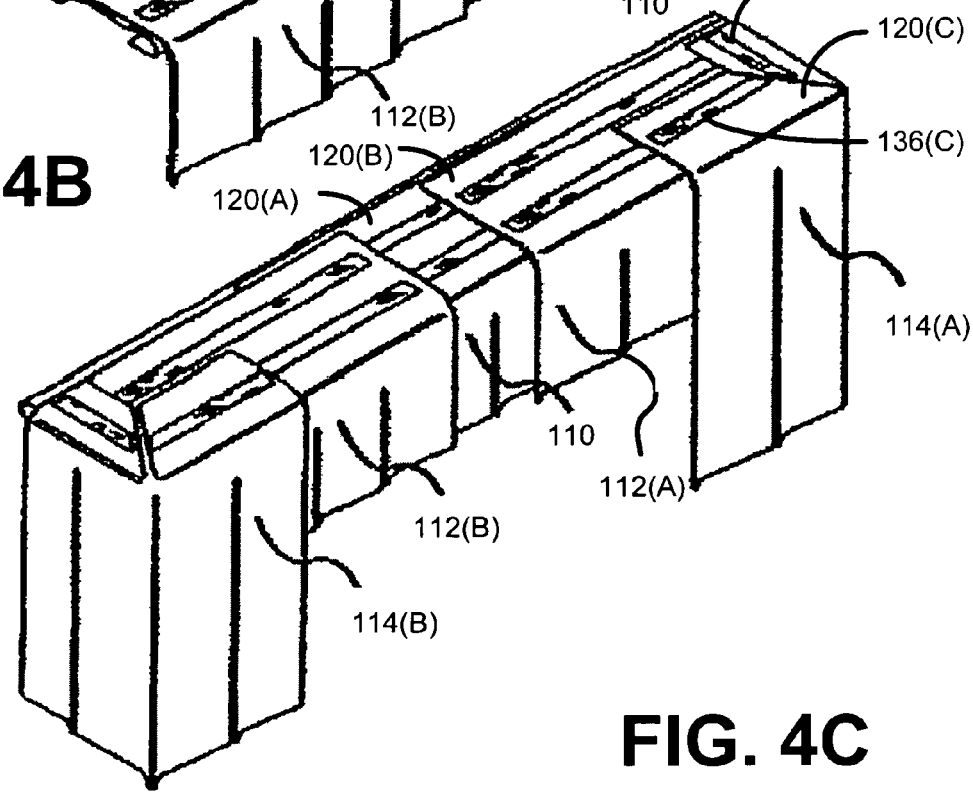
FIG. 4C

CORNICE FIXTURE

CROSS-REFERENCE TO RELATED APPLICATION

This application is a continuation in part of copending U.S. utility application entitled, "CORNICE FIXTURE," having Ser. No. 10/907,510, filed Apr. 4, 2005, which is entirely incorporated herein by reference and which claimed priority to U.S. provisional application entitled, "SNAP FIT MODULAR CORNICE ROD SYSTEM," having Ser. No. 60/592,962 filed Aug. 2, 2004, which is entirely incorporated herein by reference.

TECHNICAL FIELD

The present invention is generally related to hanging window treatments and, more particularly, is related to a system and method for slidably coupling a rod and a bracket.

BACKGROUND OF THE INVENTION

Many homes, especially well decorated homes, have decorative fixtures such as cornice fixtures, which can look like a three sided box. A cornice fixture is centered around a window and covers the top of the window. It is often made of wood, which is then padded and then covered in fabric. It can also be made of decorative wood molding, polystyrene, metal or any other decorative material.

Standard cornice fixtures include custom made fixtures and manufactured fixtures. Typically, a custom made cornice fixture includes a pair of L-shaped brackets and a wooden board, or cornice board, which extends between the brackets. Typically, the cornice board is wood and has a depth of 4.5 inches to 6 inches and a specific length, which corresponds to the size of window over which the cornice board is to be hung. Window treatments, which are frequently fabric drapes or the like, are constructed specifically to fit that board and then attached to the board with staples or Velcro™. The window treatments may be sewn together as one piece (i.e. a box valance) or can be made of multiple overlapping pieces (i.e. Swag and Cascades). The pair of brackets are attached to a wall—one bracket on each side of a window—and then the cornice board, usually with the window treatment already installed, is attached to the pair of brackets. Because the cornice board of a custom made fixture is normally made of wood, it must be cut to the desired size very accurately because it cannot expand.

Cairns, U.S. Pat. No. 5,673,741, discloses a manufactured cornice fixture having a telescopic rod and at least two brackets. The telescopic rod has attachment surfaces, which are used for removably attaching window treatments. The brackets are attached to the wall—on both sides of a window. Then, the telescopic rod is attached to the brackets such that it extends between the two brackets. Then, window treatments are attached to the attachment surfaces of the telescopic rod. As opposed to a cornice board of a custom made cornice fixture, the telescopic rod does not need to be cut to a specific length. Instead, the telescopic rod is expanded/contracted to extend between the brackets. However, this means that in order for the cornice fixture itself to be centered around the window, the brackets must be centered around the window. Consequently, installing the brackets requires very accurate measurements to ensure that they are centered around the window, which means that the installation is normally preformed by a professional.

Thus, a heretofore unaddressed need exists in the industry to address the aforementioned deficiencies and inadequacies.

SUMMARY OF THE INVENTION

Embodiments of the present invention provide a cornice fixture and method for installing the cornice fixture.

Briefly described, one embodiment of the fixture, among others, includes a bracket, which is adapted to couple to a wall, and a rod. The rod defines a longitudinal length, and window treatments are hung along its longitudinal length. The fixture also includes a means for slidably mounting the rod to the bracket. An aspect of slidably coupling the rod to the bracket is that the rod can be centered about a given point after the rod has been coupled to the bracket.

Embodiment of the present invention can also be viewed as providing methods for installing the cornice fixture. In this regard, one embodiment of such a method, among others, can be broadly summarized by the following steps: mounting two brackets to a wall, wherein a given point lies somewhere on a line connecting the two brackets; and slidably coupling a rod to the two brackets.

Other features, and advantages of the present invention will be or become apparent to one with skill in the art upon examination of the following drawings and detailed description. It is intended that all such additional methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIGS. 4A-4C are perspective views illustrating the sequence in which window treatments are attached to a rod of the cornice fixture of FIG. 1.

DETAILED DESCRIPTION

Figure 1:
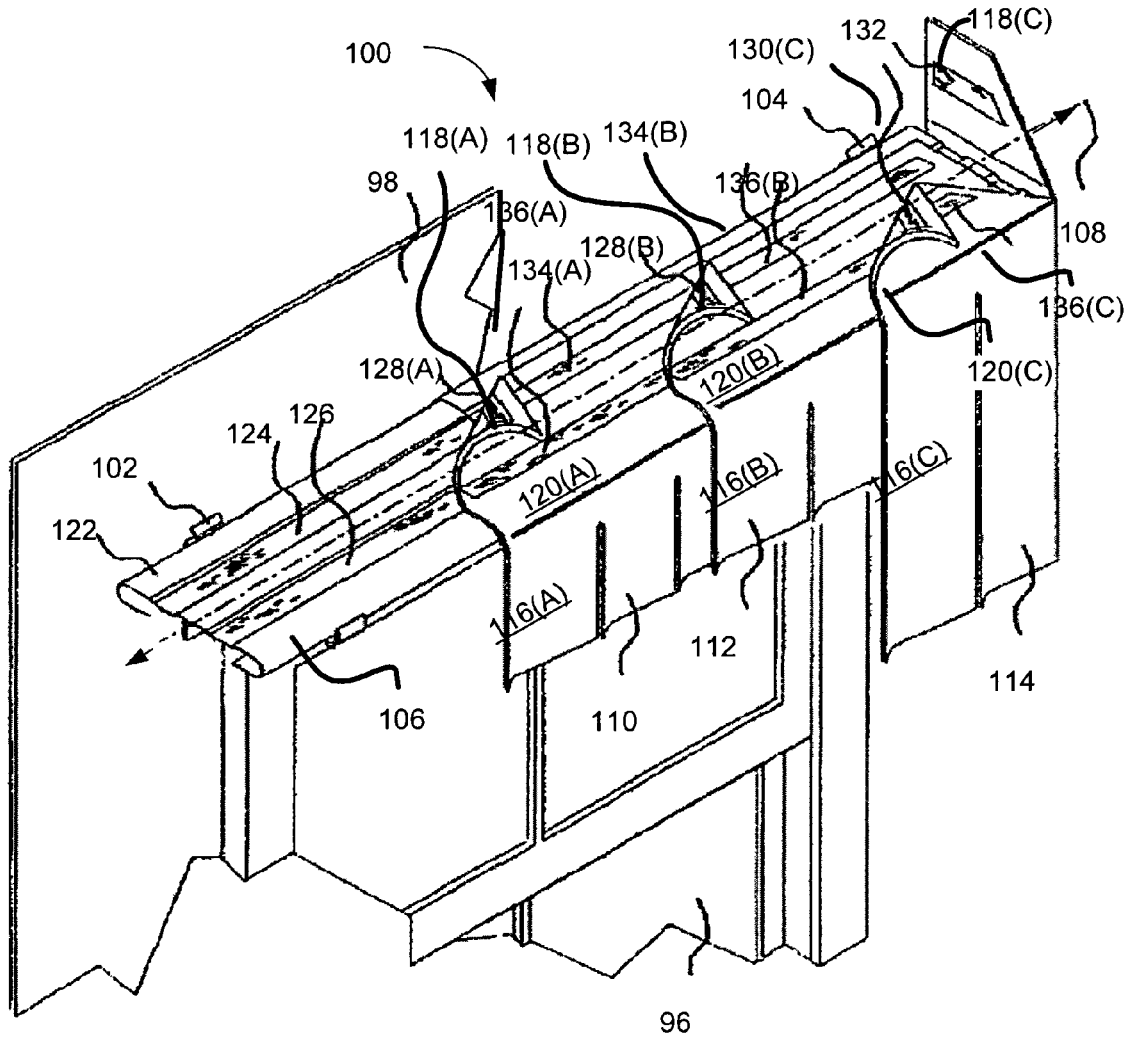
FIG. 1 is a perspective view of a cornice fixture mounted to a wall.

Referring to FIG. 1, a cornice fixture 100 is mounted to a wall 98 above a window 96. The cornice fixture 100 includes a pair of brackets 102 and 104 and a rod 106. The brackets 102 and 104 define a longitudinal axis denoted by the dashed line 108, and the rod 106 is slidably coupled to the brackets 102 and 104 such that the rod 106 can slide in directions that are generally parallel to the longitudinal axis 108.

It should be noted that the brackets 102 and 104 do not need to be centered around the window 96. Because the rod 106 extends past the brackets 102 and 104 and is adapted to slidably couple with the brackets 102 and 104, the rod 106 can be slid in the direction of the longitudinal axis 108 such that the rod 106 is centered around the window 96. With the rod 106 centered around the window 96 (or some other point), the cornice fixture 100 has the appearance of being centered around the window because most observers do not notice the brackets. Not needing to center the brackets 102 and 104 has the advantage that the brackets can be mounted to studs (not shown).

A plurality of window treatments 110, 112, and 114 are attached to the rod 106 and hang generally downward therefrom. A non-limiting example of a window treatment is a drape. In one embodiment, the rod 106 includes fasteners for removably coupling the window treatments 110, 112, and 114 to the rod 106. Examples of fasteners include, but are not limited to, hook and loop fasteners such as Velcro™, snaps, hooks, and other fasteners known to those skilled in the art. For the sake of clarity, embodiments will be described employing hook and loop fasteners, but it is to be remembered that other fasteners are intended to be within the scope of the invention. Furthermore, it should be noted that in the description hereinbelow specific locations of hook fasteners and loop fasteners are provided only for the sake of clarity and that the locations can be reversed.

Figure 2:
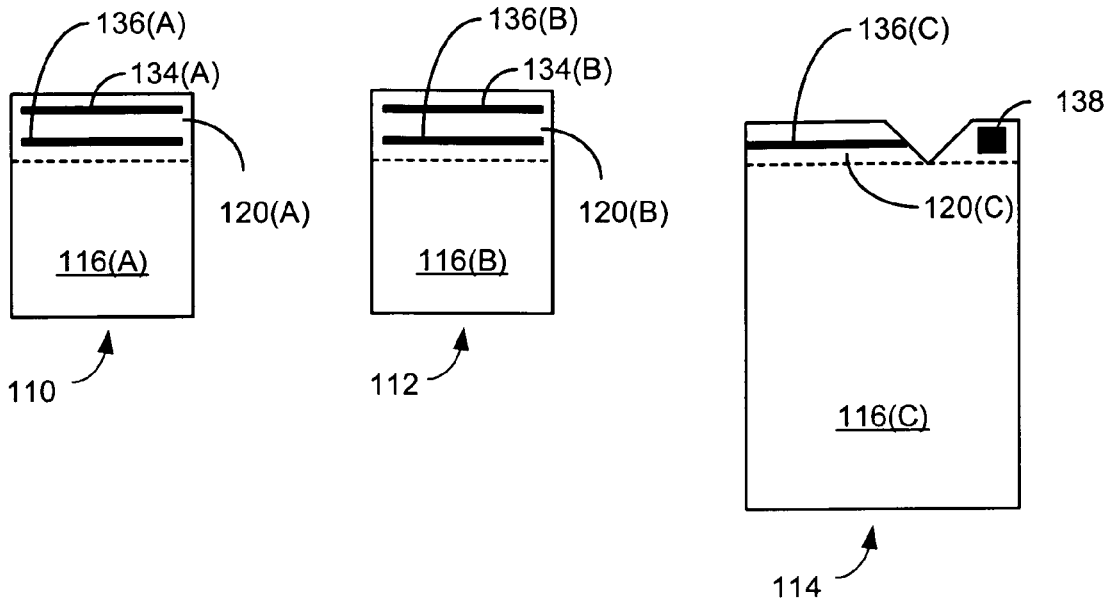
FIG. 2 is a back view of window treatments, which are attachable to the cornice fixture of FIG. 1.
Figure 3:
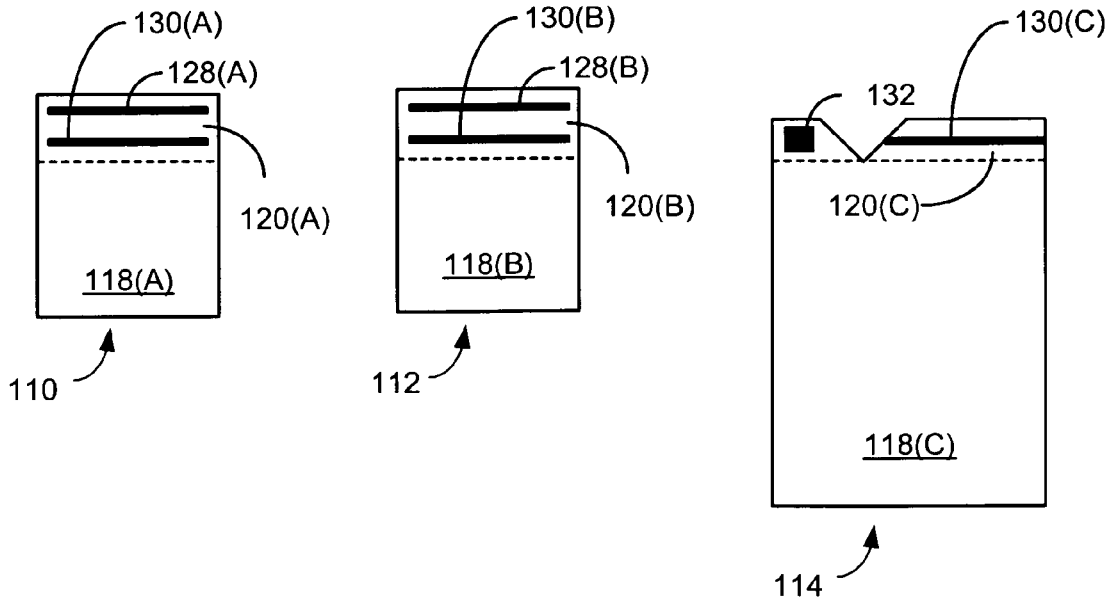
FIG. 3 is a front view of window treatments, which are attachable to the cornice fixture of FIG. 1.

Referring to FIGS. 1-3, the window treatments 110, 112, and 114 each define a front side 116(A)-116(C), respectively, and a back side 118(A)-118(C), respectively, and a top edge portion 120(A)-120(C), respectively. In operable position, the top edge portions 120(A)-120(C) are disposed over the rod 106 such that the remainder of the window treatments hang downward from the rod 106. The window treatments 110, 112, and 114 are attached to the rod and, in some embodiments, to each other, by fasteners. The rod 106 has an upper surface 122 with two strips of hook material 124 and 126 disposed thereon. Typically, the strips of hook material are affixed to the rod 106 by an adhesive.

Referring to FIG. 2, the back sides 118(A) and 118(B) of the window treatments 110 and 112, each have two strips of loop material 128(A) and 130(A) and 128(B) and 130(B), respectively, disposed thereon. The upper portion 120(C) of window treatment 114 is pre-cut to fold around an end of the rod 106. The back side 118(C) has a first strip of loop material 130(C) disposed thereon and a second strip of loop material 132 disposed thereon. In operable position, the strips of loop material 128(A) and 128(B) are aligned with portions of the hook material 124, and the strips of loop material 130(A)-130(C) are aligned with portions of the hook material 126.

Referring to FIG. 3, strips of hook material 134(A) and 134(B) are disposed on the upper portions 120(A) and 120(B), respectively. The strips of hook material 134(A) and 134(B) are generally aligned with the strips of loop material 128(A) and 128(B), respectively. Strips of hook material 136(A)-136(C) are disposed on the upper portions 120(A)-120(C), respectively, and are generally aligned with the strips of loop material 130(A)-130(C), respectively. In addition, the backside 118(C) of the upper portion 120(C) of window treatment 114 includes a strip of hook material 138, which is generally aligned with the strip of loop material 132.

Referring to FIGS. 4A-4C, window treatments can be attached to the rod 106 in a layered manner. As illustrated in FIG. 4A, the window treatment 110 is approximately centered with respect to the rod 106 and then attached to the rod 106 by pressing the strips of loop material 128(A) and 130(A) to the strips of hook material 124 and 126, respectively. Next, as illustrated in FIG. 4B, the window treatment 112(A) is positioned such that it overlies at least a portion of the window treatment 110 and aligned such that the strip of loop material 128(B) is aligned with a portion of the hook material 134(A) and with a portion of the strip of hook material 124. The alignment of the window treatment 112(A) causes the strip of loop material 130(B) to be aligned with a portion of the strip of hook material 136(A) and with a portion of the strip of hook material 126.

A window treatment 112(B), which is a mirror copy of the window treatment 112(A), is positioned over the other end of the window treatment 110 and attached in a manner that is similar to that of window treatment 112(A).

Next, as illustrated in FIG. 4C, end-window treatments 114(A) and 114(B) are attached. The end-window treatment 114(A) is positioned such that it overlies a portion of the window treatment 112(A) and then aligned such that the strip of loop material 130(C) mates with a portion of the hook material 136(B). In some embodiments, the strip of loop material 130(C) mates with a portion of the hook material 126. A portion of the end-window treatment 114(A) is folded approximately 90 degrees such that the folded portion generally covers an end of the rod 106. The strip of loop material 132 mates with at least a portion of the hook material 124 and 126 and/or a portion of the hook material 134(B) and 136(B). The end-window treatment 114(B) is attached in a manner that is similar to that of the end-window treatment 114(A).

It should be noted that the window treatments 110, 112(A), 112(B), 114(A) and 114(B) can be attached to the rod 106 before coupling the rod 106 to the brackets 102 and 104. This feature provides a measure of safety to the end-user because it reduces the amount of time that the end-user must stand on a chair or ladder while installing the cornice fixture 100. Furthermore, attaching the window treatments before coupling the rod 106 to the brackets 102 and 104 provides a measure of convenience to the end-user because the end-user can attach the window treatments without having to work with his or her hands above their head. Because the rod 106 need not be coupled to the brackets 102 and 104 prior to attaching the window treatments, the end-user can attach the window treatments with the rod laying on a table or work bench, and consequently, the end-user can easily view the top of the rod 106 while attaching the window treatments. After the rod and window treatments are coupled to the brackets 102 and 104, the rod and window treatments can be slid back and forth in the directions denoted by dashed line 108 (see FIG. 1) such that the rod and window treatments can be centered around a given point such as window 96.

Figure 5:
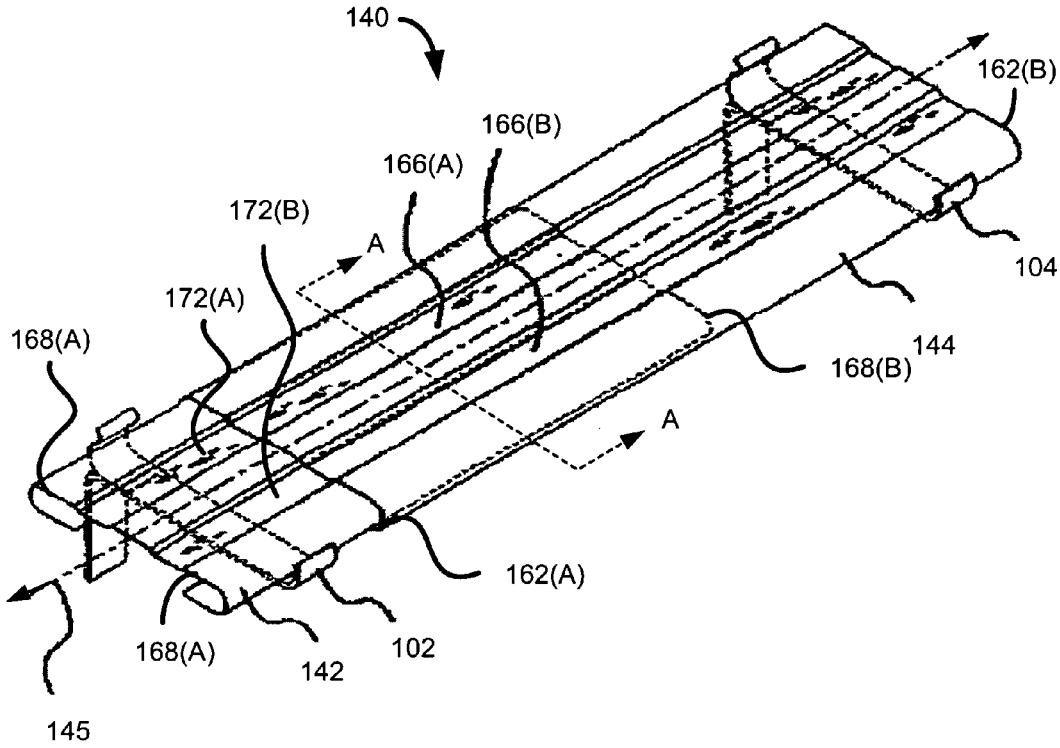
FIG. 5 is a perspective view of a rod and brackets of the cornice fixture of FIG. 1.

FIG. 5 illustrates a perspective view of a rod 140 and the brackets 102 and 104. The rod 140 is a telescopic rod having an inner member 142 and an outer member 144. The dashed line 145 denotes the axis along which the rod 140 can telescope, and as will be explained in detail hereinbelow, the dashed line 145 also denotes the directions along which the rod 140 can be slid with respect to the brackets 102 and 104.

Figure 6A:
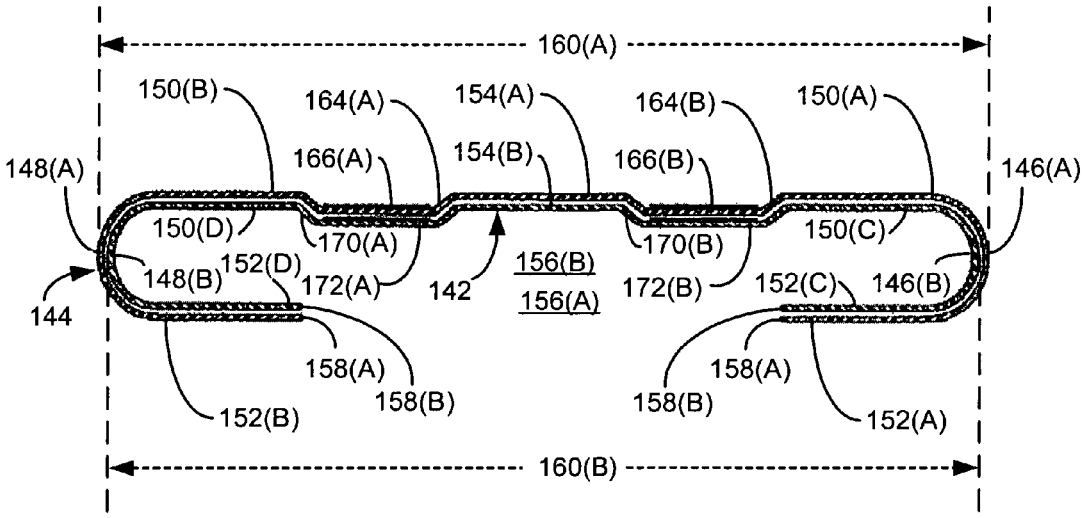
FIG. 6A is a cross sectional view of the rod of FIG. 5.

FIG. 6A illustrates the rod in cross sectional view as seen along line A-A of FIG. 5. Generally, the inner member 142 is complimentary in shape with respect to the outer member 144 such that the inner member 142 can slide within the outer member 144.

In one embodiment, the outer member 144 is generally C-shaped in cross section. The outer member 144 includes a curved front portion 146(A) and a curved rear portion 148(A). The front portion 146(A) and rear portion 148(A) are approximately U-shaped and are aligned to be inwardly opening and approximately horizontal such that the front portion 146(A) includes an upper leg 150(A) and a lower leg 152(A) and such that the rear portion 148(A) includes an upper leg 150(B) and a lower leg 152(B). An upper surface 154(A) extends between the upper legs 150(A) and 150(B). The outer member 144 defines a hollow interior 156(A) with an opening 158(A) extending between the lower legs 152(A) and 152(B).

The inner member 142 is generally C-shaped in cross section. The inner member 142 includes a curved front portion 146(B) and a curved rear portion 148(B). The front portion 146(B) and rear portion 148(B) are approximately U-shaped and are aligned to be inwardly opening and approximately horizontal such that the front portion 146(B) includes an upper leg 150(C) and a lower leg 152(C) and such that the rear portion 148(B) includes an upper leg 150(D) and a lower leg 152(D). An upper surface 154(B) extends between the upper legs 150(C) and 150(D). The inner member 142 defines a hollow interior 156(B) with an opening 158(B) extending between the lower legs 152(C) and 152(D).

The outer member 144 defines a transverse width 160(A) that extends inclusively between the front portion 146(A) and the rear portion 148(A) and a longitudinal length, $L_1$, extending from opposed ends 162(A) and 162(B). The upper surface 154(A) defines two channels 164(A) and 164(B), which extend along the longitudinal length of the upper surface 154(A). The channels 164(A) and 164(B) carry strips of hook material 166(A) and 166(B) along at least a portion of their longitudinal lengths.

The inner member 142 defines a transverse width 160(B) that extends inclusively between the front portion 146(B) and the rear portion 148(B) and a longitudinal length, $L_2$, extending from extending from opposed ends 168(A) and 168(B). The upper surface 154(B) defines two channels 170(A) and 170(B), which extend along the longitudinal length of the upper surface 154(B). The channels 170(A) and 170(B) carry strips of hook material 172(A) and 172(B) along at least a portion of their longitudinal lengths.

Typically, the strips of hook material 166(A) and 166(B) are secured to the outer member 144 by an adhesive such as glue or tape and are positioned on the outer member 144 such that the hook material will engage loop material disposed on the back side 118 of window treatments.

Similarly, the strips of hook material 172(A) and 172(B) are secured to the inner member 144 by an adhesive such as glue or tape and are positioned on the inner member 142 such that the hook material will engage loop material disposed on the back side 118 of window treatments.

As previously stated, the inner member 142 telescopes within the outer member 144. Thus, the transverse width 160(A) is larger than the transverse width 160(B). Similarly, the channels 170(A) and 170 (B) are deep enough such that the strips of hook material 172(A) and 172(B) are not engaged by the outer member 144.

Figure 6B:
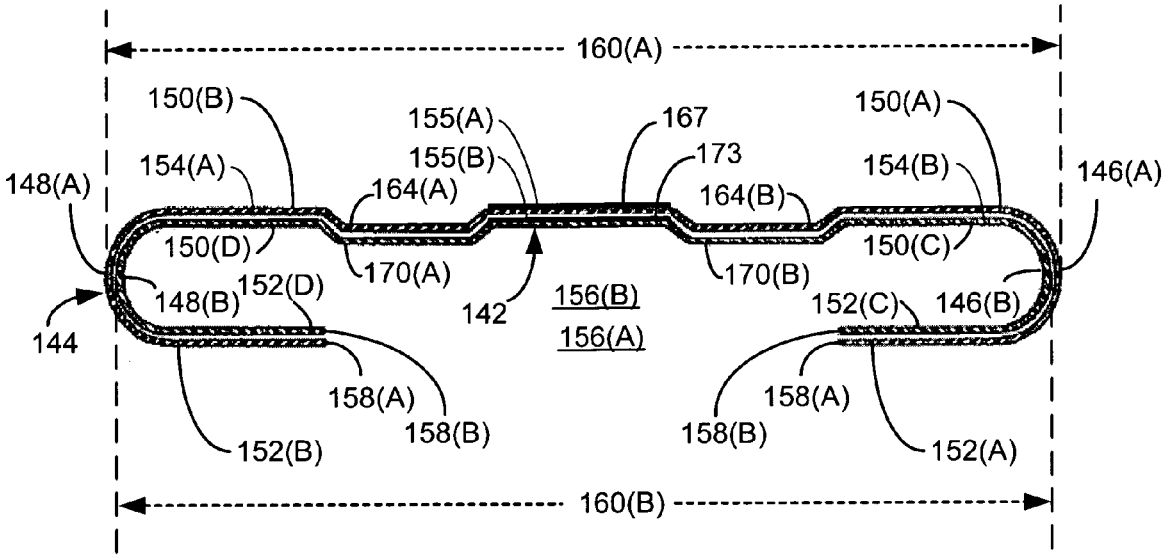
FIG. 6B is a cross sectional view of a rod.

FIG. 6B illustrates another embodiment of the rod in cross sectional view as seen along line A-A of FIG. 5. In this embodiment, the inner member 142 is complimentary in shape with respect to the outer member 144 such that the inner member 142 can slide within the outer member 144.

The upper surface 154(A) of the outer member 144 defines the two channels 164(A) and 164(B), and interposing the two channels 164(A) and 164(B) is a raised segment 155(A), which extends along the longitudinal length of the upper surface 154(A). In one embodiment, the raised segment 155 (A) is raised with respect to the channels 164(A) and 164(B) and is approximately in the same plane as the upper legs 150(A) and 150(B). However, in alternative embodiments, the raised segment 155(A) can be raised with respect to the channels 164(A) and 164(B) and raised with respect to the upper legs 150(A) and 150(B). Similarly, the raised segment 155(A) can be raised with respect to the channels 164(A) and 164(B) and lowered with respect to the upper legs 150(A) and 150(B).

The upper surface 154(B) of the inner member 142 defines the two channels 170(A) and 170(B), and interposing the two channels 170(A) and 170(B) is a raised segment 155(B), which extends along the longitudinal length of the upper surface 154(B). In one embodiment, the raised segment 155 (B) is raised with respect to the channels 170(A) and 170(B) and is approximately in the same plane as the upper legs 150(C) and 150(D). However, in alternative embodiments, the raised segment 155(A) can be raised with respect to the channels 170(A) and 170(B) and raised with respect to the upper legs 150(C) and 150(D). Similarly, the raised segment 155(A) can be raised with respect to the channels 170(A) and 170(B) and lowered with respect to the upper legs 150(C) and 150(D).

The inner member 142 defines a transverse width 160(B) that extends inclusively between the front portion 146(B) and the rear portion 148(B) and a longitudinal length, $L_2$, extending from extending from opposed ends 168(A) and 168(B). The upper surface 154(B) defines two channels 170(A) and 170(B), which extend along the longitudinal length of the upper surface 154(B). The channels 170(A) and 170(B) carry strips of hook material 172(A) and 172(B) along at least a portion of their longitudinal lengths.

In one embodiment, the raised segments 155(A) and 155 (B) carry strips of hook material 167 and 173, respectively, along at least a portion of their longitudinal lengths. In some embodiments, strips of hook material (not shown) can also be carried on the upper legs 150(A) and 150(C) and/or by the upper legs 150(B) and 150(D) and/or all combinations and permutations thereof. Furthermore, it should be noted that in some embodiments, the inner member 142 and the outer member 144 might only have one channel disposed thereon, and in that case, the upper legs are raised with respect to the channel.

As previously stated, the inner member 142 telescopes within the outer member 144. Thus, the transverse width 160(A) is larger than the transverse width 160(B). Similarly, the raised segments 155(A) is sufficiently raised such that the strips of hook material 173 is not engaged by the outer member 144. Similarly, the inner member 142 is configured to slide within the outer member 144 such that hook material disposed on either of the upper legs (150(C) and 150(D)) or upon both of the upper legs 150(C) and 150(D) is not engaged by the outer member 144.

Figure 7:
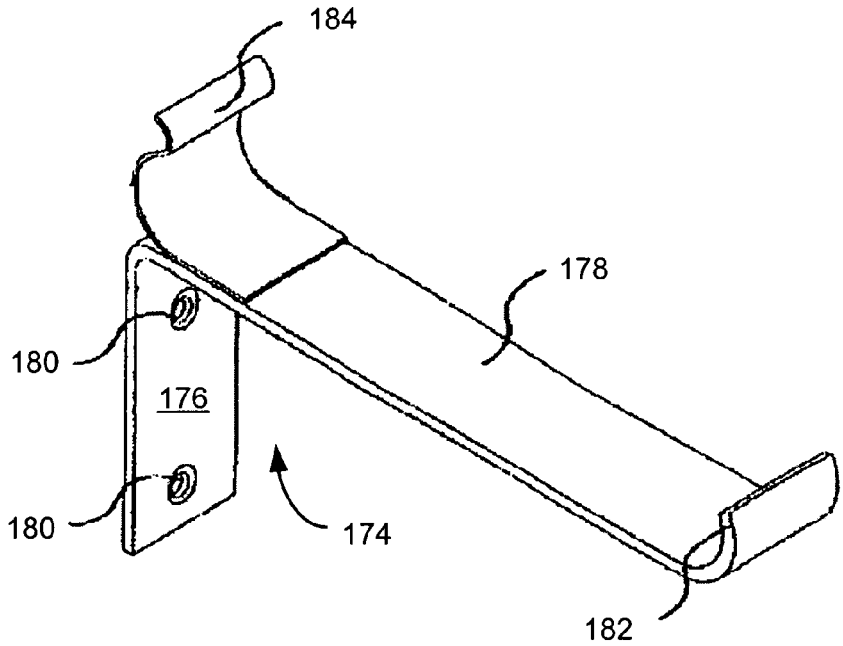
FIG. 7 is a perspective view of a bracket of FIG. 5.

Referring now to FIG. 7, in one embodiment, a bracket 174 is generally L-shaped having a generally vertical leg 176 and a generally horizontal leg 178 extending outward from the leg 176. The leg 176 includes screw holes 180 for attaching the bracket to a mounting surface such as a wall. The leg 178 includes an upwardly curved front end 182 and a tab 184, which are used to hold the rod 140 onto the bracket 174. The upwardly curved front end 182 is designed to be rigid and generally conform in shape to the front portions 146(A) and 146(B). The tab 184 is illustrated in its natural or relaxed state, and the tab 184 is designed to be resilient such that it will return to its natural state after being pushed either forward or backwards. The tab 184 is shaped such that it generally conforms to the shape of the rear portions 148(A) and 148(B).

Figure 8:
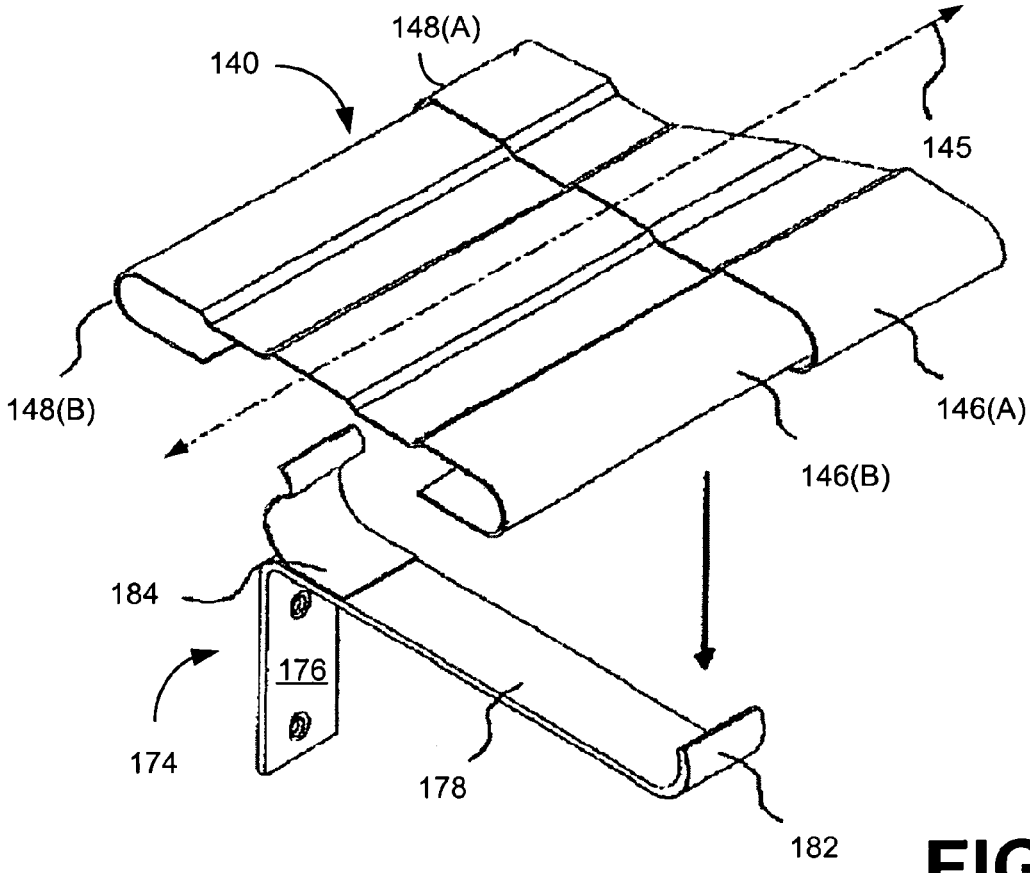
FIG. 8 is an exploded partial view of the rod and one of the brackets of FIG. 5.

FIG. 8, which is an exploded perspective view of the rod 140 and bracket 174, illustrates the coupling of the rod 140 and bracket 170. The rod 140 is positioned above the bracket 174. The rod 140 is tilted slightly forward and lowered such that the front portion 146(A) (or 146(B)) engages the upwardly curved front end 182, and then, the rear portion 148(A) (or 148(B)) is push downward such that the rear portion engages the tab 184. The downward pressure on the rear portion 148 causes the tab 184 to be bent backwards, which thereby enables the rear portion 148 to move downward. The tab 184 snaps back into place when the rod 140 is in operable position, thereby engaging the rear portion 148. It should be noted that the rod 140 is snapped into the bracket 174 and is held thereon by pressure exerted by the tab 184 and upwardly curved front end 182. Furthermore, in some embodiments, the pressure fit of the rod 140 in the bracket 174 is such that the rod can be slid in the directions denoted by line 145.

Figure 9:
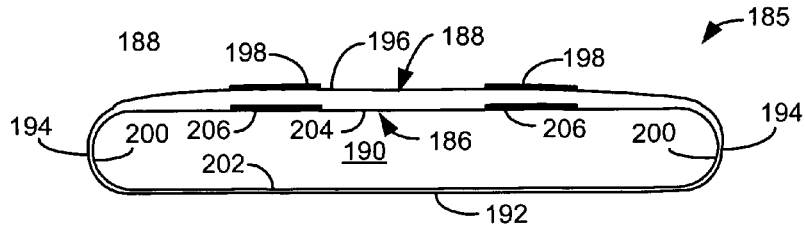
FIG. 9 is a cross sectional view of a rod.

FIG. 9 illustrates another embodiment of a rod 185. The rod 185 includes an inner member 186 and an outer member 188. The outer member 188 defines a hollow interior 190 through which the inner member 186 slides. The outer member 188 defines generally flat bottom 192, opposed ends 194, which are generally U-shaped, and an upper surface 196. The upper surface 196 is bowed or arched and extends between the opposed ends 194. The upper surface 196 also has two strips of hook material 198 disposed thereon.

The inner member 186 includes opposed ends 200 and a bottom surface 202 and an upper surface 204. The bottom surface 202 and the upper surface 204 are generally flat and extend between the opposed ends 200. The upper surface 204 has two strips of hook material 206 disposed thereon. The inner member is sized and shaped such that it can slide within the interior 190 of the outer member. The upper surface 196 is arched or bowed such that the two strips of hook material 206 are not engaged by the upper surface 196 as the inner member 186 is slid into and out of the outer member 188.

Figure 10:
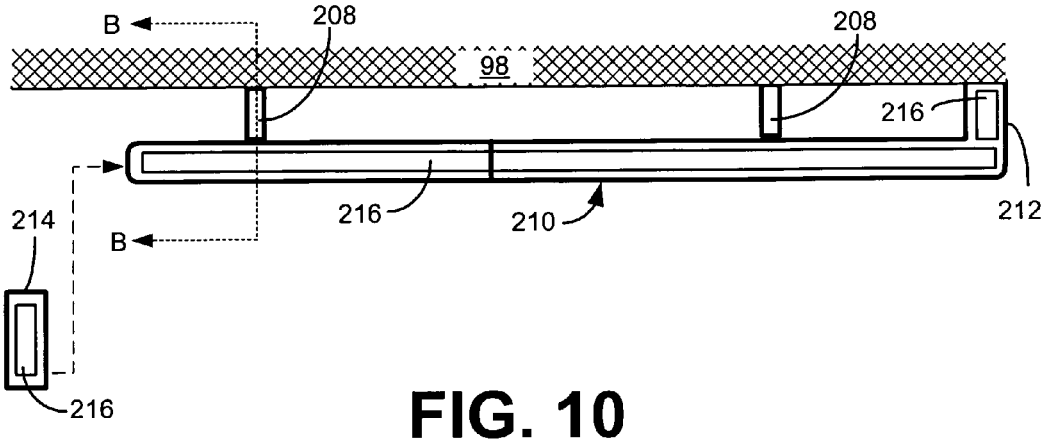
FIG. 10 is a top view of a cornice fixture.

FIG. 10 illustrates yet another embodiment of a pair of brackets 208 and a rod 210. The rod 210 and brackets 208 are formed such that the rod 210 can be pushed generally horizontally onto the brackets 208 and snap in place. In some embodiments, the rod 210 is a telescoping rod, and in other embodiments, the rod can be a non-telescoping. In some embodiments, the rod 210 includes a formed end 212 that extends generally rearward from the rod 210. The formed end 212 forms a side member such that a window treatment(s) can be hung from the formed end 212. In other embodiments, the rod 210 includes a separable end cap 214 that is adapted to couple to the rod 210. Generally, the end cap 214 is coupled to the rod 210 by a pressure fit.

Figure 11A:
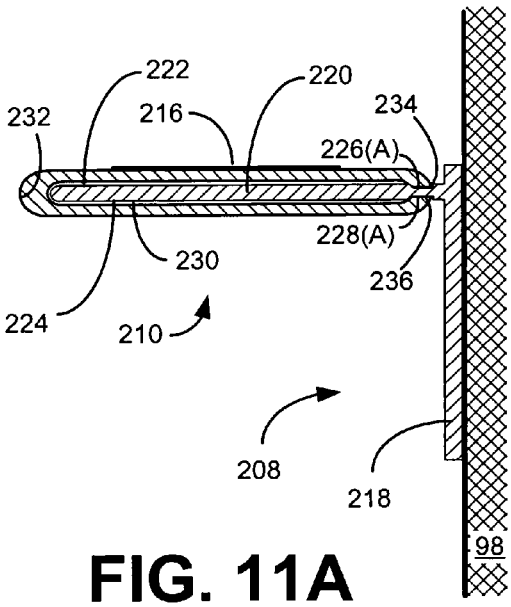
FIG. 11A is a cross sectional view of a rod and a bracket of the cornice fixture of FIG. 10.
Figure 11B:
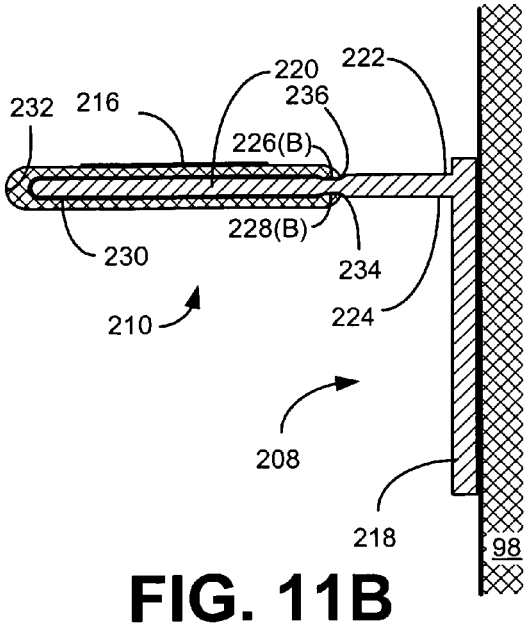
FIG. 11B is a cross sectional view of a rod and a bracket of the cornice fixture of FIG. 10.

FIGS. 11A and 11B illustrate two embodiments of the rod 210 and bracket 208 as seen in cross sectional view along line B-B. In both embodiments, the bracket 208 includes a generally vertical leg 218 and a generally horizontal leg 220, which extends outward from the leg 218. The leg 220 has an upper surface 222 and a lower surface 224. As illustrated in FIG. 11A, a pair of grooves 226(A) and 228(A) are formed in the leg 220 relatively proximal to the leg 218. Whereas, FIG. 11B illustrates a pair of grooves 226(B) and 228(B) that are formed in leg 220 approximately one-third of its length away from the leg 218. The exact positions of the pairs of grooves (226(A), 228(A)) and (226(B), 228(B)) are a generally a matter of design choice.

The rod 210 defines a generally hollow interior 230 and opposed ends 232 and 234. The end 234 defines an opening 236 that extends to the hollow interior 230. The leg 220 and hollow interior 230 are complementary in shape such that the portion of the 220 that extends outward from the pair of grooves (226(A), 228(A)) or (226(B), 228(B)) is received by the hollow interior 230. The opening 236 is shaped to conform to the pair of grooves.

The rod 210 is coupled to the brackets 208 by aligning the opening 236 with the legs 220 and then pushing the rod 210 inward towards the leg 218. The rod 210 is slid onto the leg 220 until the opening 236 engages the pair of grooves. Typically, the rod 210 is made of a resilient material and the opening 236 is formed such that the end 234 squeezes the grooves to hold the rod in place.

As previously described, the pair of grooves 226(A) and 228(A) are proximal to the leg 218. In this embodiment, the end 234 is proximal to the wall 98. Thus, in this embodiments, the formed end 212 and/or the end cap 214 are not necessary for hanging side window treatments, i.e., window treatments that extend outward from the wall 98.

It should be noted that the opening 236 engages the grooves to hold the rod 210 onto leg 220. However, even when the rod 210 is mounted to the brackets 208, the rod 210 can be slid in directions that are generally parallel to the wall 98. Thus, the rod 210 can be centered with respect to a given point after the rod 210 has been coupled to the brackets.

Figure 12:
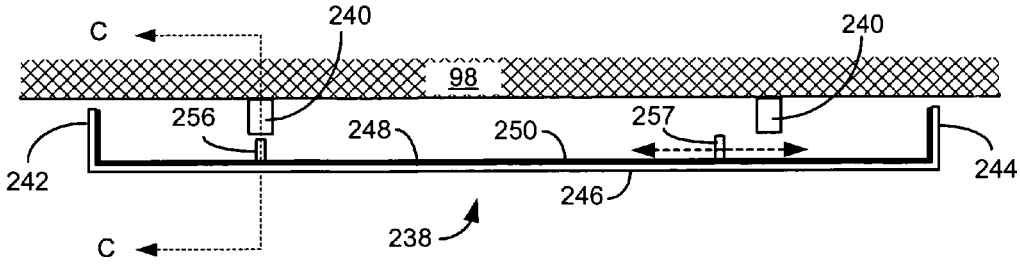
FIG. 12 is a top view of a cornice fixture.
Figure 13:
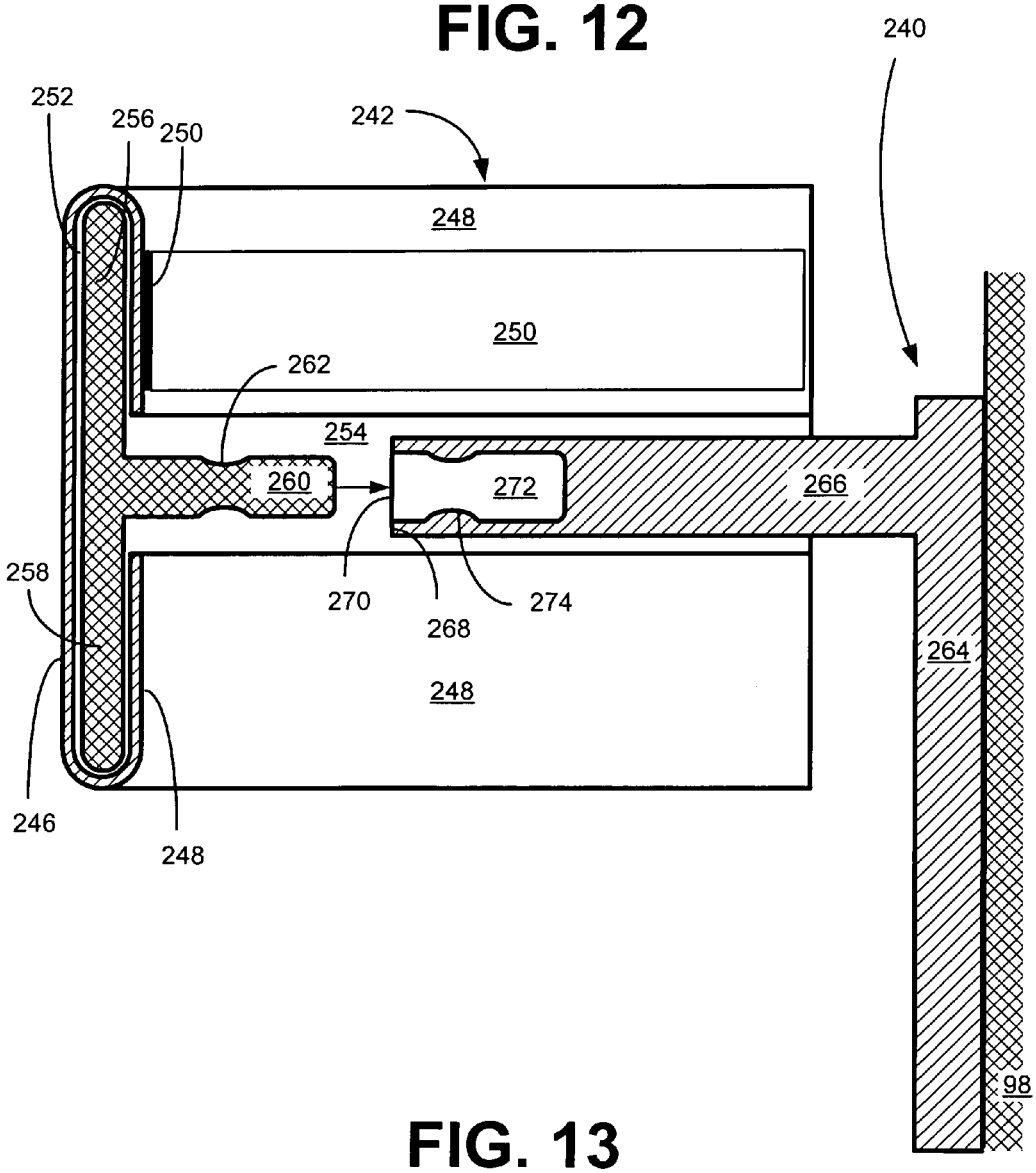
FIG. 13 is a cross sectional view of a rod and a bracket of the cornice fixture of FIG. 12.

FIGS. 12 and 13 illustrate yet another embodiment of the cornice fixture 100, which comprises a rod 238 and a pair of brackets 240. FIG. 13 is a cross sectional view as seen along line C-C.

In some embodiments, the rod 238 is telescopic. The rod 238 extends longitudinally between opposed ends 242 and 244. The opposed ends 242 and 244 extend inward. The rod defines an outer face 246 and an inner face 248. A strip of hook material 250 is disposed on the inner face 246. The rod 238 defines a generally hollow interior 252.

A slot 254 is defined in the inner face 246. The slot 254 provides an opening into the hollow interior 252 of the rod. The hollow interior 252 and slot 254 are configured to receive mounting members 256. Typically, the mounting members 256 are slid into the hollow interior 252 at one or the other of the opposed ends 242 or 244. As denoted by the dashed line 257, the mounting members 256 can slid along between the opposed ends 242 and 244. The mounting members 256 can also be slid along the opposed ends 242 and 244.

Each of the mounting members 256 include a body 258 that fits within the hollow interior 252. A stub 260 extends outward from the body 258 through the slot 254. The stub 260 defines a notch 262. Typically, the notch 262 circumscribes the stub 260.

The brackets 240 define a generally vertical leg 264, which is mounted to the wall 98, and a generally horizontal leg 266, which extends outward from the leg 264 to an end 268. The end 268 defines an opening 270 to a hollow interior 272. The hollow interior 272 is shaped and configured to receive at least a portion of the stub 260. The hollow interior 272 defines a protrusion 274 that is shaped to conform to the notch 262.

In the embodiment illustrated in FIGS. 12 and 13, the mounting brackets 240 are first mounted to the wall 98. Then window treatments (not shown) are attached to the hook material 250. It should be noted that the window treatments can be attached to the rod 238 before the rod is coupled to the brackets 240 or afterwards. The rod 238 is then positioned proximal to the brackets 240, and then the mounting members 258 are aligned with the brackets 250 by sliding the mounting members to appropriate positions. The tabs 260 are aligned with the openings 270 of the mounting brackets 240, and then the rod is pushed inward such that the tabs 260 are received by the hollow interiors 272 of the mounting brackets 240. It should be noted that after the mounting members 258 are coupled to the mounting brackets 240, the rod 238 can be slid in directions parallel to the wall 98. Thus, the rod 238 can be centered about a given point after it is coupled to the mounting brackets 240.

Figure 14:
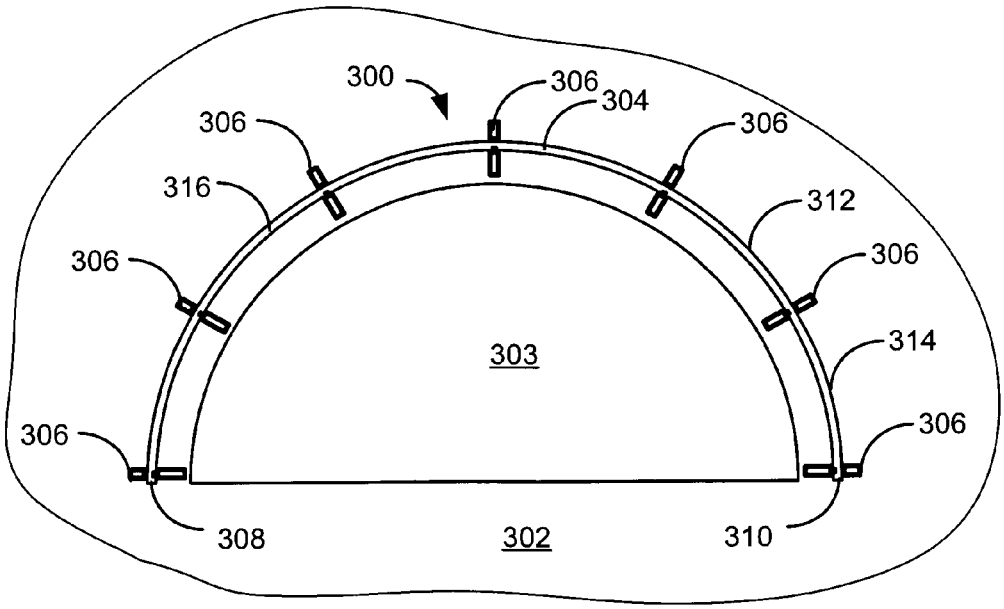
FIG. 14 is a view of a curved cornice fixture mounted to a wall.

FIG. 14 illustrates yet another embodiment of a cornice fixture 300 mounted to a wall 302 having a curved window 303. The cornice fixture 300 includes a rod 304 and a plurality of brackets 306. Typically, the rod 304 is made from a material such as, but not limited to, vinyl, plastic, polyurethane, etc. so that the rod 304 can be mounted to the wall 302 and curved in an arc. As previously described hereinabove, the rod 304 is adapted to couple to the brackets by pressing the rod onto the brackets 306.

In the embodiment illustrated, the rod 304 is a single member extending between opposed ends 308 and 310. The rod 304 defines an outer surface 312. The outer surface 312 carries a fastener 314 such as a strip of hook material. Typically, window treatments (not shown) having complimentary fasteners are attached to the fasteners 314. It should be noted that the rod 304 also defines a front surface 316, and in some embodiments, the front surface 316 can carry the fastener 314.

Although the present embodiment is illustrated as a rod having a single member, in some embodiments, the rod 304 is comprised of multiple telescopic members.

Typically, the installation of the embodiment illustrated in FIG. 13 is performed in manner similar to that previously described. First, the brackets 306 are mounted to the wall 302. Next, the rod 304 is coupled to the brackets 306 by pressing the rod 304 to the brackets 306. As previously described hereinabove, the rod 304 slidably couples to the brackets 306. Thus, the rod 304 can be slid clockwise or counter-clockwise such that the opposed ends 308 and 310 are at desired locations.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method of mounting a cornice fixture, the method comprising the steps of:

mounting two brackets to a wall at least partially above a window without the two brackets being centered relative to the window, wherein each bracket is generally L-shaped and comprises a vertical leg which is mounted to the wall and a generally C-shaped horizontal leg extending outward from the vertical leg and comprising a pair of upwardly curved end portions that are spaced apart to receive a generally C-shaped telescopic rod having downwardly curved end portions and an interior portion with a raised segment on at least a portion of the longitudinal length of the telescopic rod;

telescoping the C-shaped telescopic rod to accommodate a width of the window;

inserting the generally C-shaped telescopic rod between the upwardly curved end portions of the two brackets with the downwardly curved end portions of the C-shaped telescopic rod slidably engaged with the upwardly curved end portions of the two brackets;

centering the C-shaped telescopic rod relative to the window by sliding the C-shaped telescopic rod relative to the two brackets; and attaching a window treatment to the raised segment.

2. The method of claim 1, further comprising the step of:

after slidably coupling the rod to the two brackets, sliding the rod in a direction that is generally parallel to a line connecting the two brackets such that the rod is centered around a given point on the line connecting the two brackets.

3. The method of claim 1, wherein the step of slidably coupling the rod to the two brackets further comprises the steps of:

aligning the rod above the two brackets;

pressing the rod downward; and engaging a tab disposed on a first bracket of two brackets, wherein the engagement of the tab holds the rod onto the first bracket.

4. A cornice fixture for decorating a wall, the cornice fixture comprising:

a pair of brackets, each bracket having a first leg for coupling to a wall and a generally C-shaped second leg, wherein the second leg extends generally outward from the first leg and comprises upwardly curved first and second end portions;

a telescopic rod having an inner member and an outer member, wherein the outer member defines a first generally hollow interior, and wherein the inner member is configured to slide in and out of the outer member through at least a portion of the first hollow interior, and wherein the inner member and the outer member each define an exterior surface having a generally C-shaped cross-section adapted to be resiliently and slidably received between the upwardly curved first and second end portions of the pair of brackets, and wherein the exterior surface further comprises a raised segment on at least a portion of the longitudinal length of the inner and outer members; and a window treatment attachment member disposed on the raised segment for removably attaching at least one window treatment to the rod.

5. The cornice fixture of claim 4, wherein the outer member of the rod defines a first upper surface extending between a first front portion and a first rear portion, wherein the inner member of the rod defines a second upper surface extending between a second front portion and a second rear portion, wherein the first upper surface is bowed, and wherein the window treatment attachment member is disposed on the first upper surface and the second upper surface.

6. The cornice fixture of claim 4, wherein the outer member of the rod defines a first rear surface extending between a first upper portion and a first lower portion, wherein the inner member of the rod defines a second rear surface extending between a second upper portion and a second lower portion, wherein the window treatment attachment member is disposed on the first rear surface and the second rear surface, wherein when the rod is in operable position a substantial portion of the first and second rear surfaces face towards the wall.

7. The cornice fixture of claim 4, wherein each of the second legs of the pair of brackets includes a pair of coupling members, wherein when the brackets are in operable position, each coupling member extends generally upward, and wherein each pair of coupling members are configured to receive the rod between the coupling members.

8. The cornice fixture of claim 7, wherein when the rod is positioned between the pair of coupling members, the pair of coupling members exert pressure on the rod.

9. The cornice fixture of claim 7, wherein for each pair of coupling members, at least one of the coupling members is resilient, wherein the at least one resilient coupling member is pressed away from its natural state while the rod is being coupled to the brackets, and the at least one resilient coupling member moves back towards its natural state when the rod is in operational position.

10. The cornice fixture of claim 4, wherein the outer member of the rod defines a first upper surface having a first raised segment, and the inner member defines a second upper surface having a second raised segment, wherein the window treatment attachment member is disposed on at least a portion of the first raised segment and the second raised segment.

11. The cornice fixture of claim 4, wherein the outer member of the rod defines a first upper surface having a first channel, and the inner member defines a second upper surface having a second channel, wherein the window treatment attachment member is disposed on at least a portion of the first channel and the second channel.

* * * * *